US009849331B2

(12) United States Patent
Jhang

(10) Patent No.: US 9,849,331 B2
(45) Date of Patent: Dec. 26, 2017

(54) ELLIPTICAL STEPPER

(71) Applicant: A-Lan Jhang, Taichung (TW)

(72) Inventor: A-Lan Jhang, Taichung (TW)

(73) Assignees: SHANG JIA YU CO., LTD., Taichung (TW); QUIN FORM INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/148,521

(22) Filed: May 6, 2016

(65) Prior Publication Data

US 2017/0319899 A1 Nov. 9, 2017

(51) Int. Cl.

| | |
|---|---|
| ***A63B 22/04*** | (2006.01) |
| ***A63B 22/06*** | (2006.01) |
| ***A63B 23/04*** | (2006.01) |
| ***A63B 22/20*** | (2006.01) |
| *A63B 22/00* | (2006.01) |

(52) U.S. Cl.

CPC ..... *A63B 22/0664* (2013.01); *A63B 22/20* (2013.01); *A63B 22/201* (2013.01); *A63B 22/203* (2013.01); *A63B 23/0405* (2013.01); *A63B 22/0061* (2013.01); *A63B 2022/0033* (2013.01); *A63B 2022/206* (2013.01)

(58) Field of Classification Search

CPC ..... A63B 22/0664; A63B 22/0025; A63B 22/0028; A63B 22/0046; A63B 22/0048; A63B 22/0061; A63B 22/06; A63B 22/0605; A63B 22/20; A63B 22/201; A63B 22/203; A63B 23/0405; A63B 23/04; A63B 23/0417; A63B 23/0423; A63B 23/0429; A63B 23/0476; A63B 23/0482; A63B 23/0488; A63B 23/0494; A63B 2022/0033; A63B 2022/0038; A63B 2022/0092; A63B 2022/0094; A63B 2022/0097; A63B 2022/206

See application file for complete search history.

(56) References Cited

U.S. PATENT DOCUMENTS

| | | | | |
|---|---|---|---|---|
| 7,014,595 | B2 * | 3/2006 | Bruno | A63B 22/203 482/51 |
| 9,474,930 | B2 * | 10/2016 | Hsu | A63B 23/0476 |
| 2005/0064996 | A1 * | 3/2005 | Chen | A63B 22/0056 482/53 |
| 2005/0239606 | A1 * | 10/2005 | Lin | A63B 22/0069 482/52 |

(Continued)

*Primary Examiner* — Loan H Thanh
*Assistant Examiner* — Megan Anderson
(74) *Attorney, Agent, or Firm* — Egbert Law Offices, PLLC

(57) ABSTRACT

An elliptical stepper includes a base, a damping device mounted on the base, two crank devices respectively laterally mounted to two opposite sides of the damping device. Each crank device has a stepping device mounted thereon and each stepping device has a roller set mounted to a bottom thereof, wherein the roller set is universally rolled relative to a corresponding one of the two stepping device. The base includes two opposite sides each having a guiding structure disposed thereon. Each guiding structure includes at least one rail having a front end outwardly extending relative to a center line of the base. Each roller set is moved along a corresponding one of the two guiding structures such that each stepping device provides a wiggling effect when moved along an elliptical route.

5 Claims, 8 Drawing Sheets

(56) References Cited

U.S. PATENT DOCUMENTS

| | | | | |
|---|---|---|---|---|
| 2008/0146417 | A1* | 6/2008 | Chang | A63B 22/0064 482/70 |
| 2008/0167165 | A1* | 7/2008 | Liao | A63B 22/001 482/52 |
| 2008/0171641 | A1* | 7/2008 | Chang | A63B 22/0664 482/54 |
| 2013/0231217 | A1* | 9/2013 | Miller | A63B 22/001 482/52 |

* cited by examiner

ELLIPTICAL STEPPER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a stepper, and more particularly to an elliptical stepper.

2. Description of Related Art Including Information Disclosed Under 37 CFR 1.97 and 37 CFR 1.98

In various exercisers, an elliptical trainer is popular because the elliptical trainer can imitate motions of feet and legs during walking. However, the original elliptical trainer has a great volume such that the original elliptical is not suitable for indoors operation in many family spaces. Consequently, some small-sized elliptical steppers are marketed.

However, whatever the great original elliptical trainer or the small-sized elliptical stepper, they have a mature structure and are manufactured along an immutable skill such that more and more users feel that elliptical exercisers, including the great original elliptical trainer or the small-sized elliptical stepper, are boring machines. It is a serious bottleneck for manufacturers to develop new elliptical exercisers.

The present invention has arisen to mitigate and/or obviate the disadvantages of the conventional elliptical exercisers.

BRIEF SUMMARY OF THE INVENTION

The main objective of the present invention is to provide an improved elliptical stepper that has two roller sets moved along a corresponding one of the two guiding structures.

To achieve the objective, the elliptical stepper in accordance with the present invention comprises a base divided into a front section and a rear section. Two guiding structures are respectively disposed on two opposite sides of the base. Each guiding structure includes at least one rail having a front end outwardly extending relative to a center line of the base, wherein the route of the at least one rail is selected from a group consisted of linear and curved. A damping device is mounted on the base. Two crank devices are respectively laterally mounted to two opposite sides of the damping device. Each crank device has a stepping device mounted thereon and each stepping device has a roller set mounted to a bottom thereof. Each roller set is guided by a corresponding one of the rails for provides a wiggling effect to the stepping device when moved along the corresponding rail.

Further benefits and advantages of the present invention will become apparent after a careful reading of the detailed description with appropriate reference to the accompanying drawings.

DETAILED DESCRIPTION OF THE INVENTION

Figure 1:
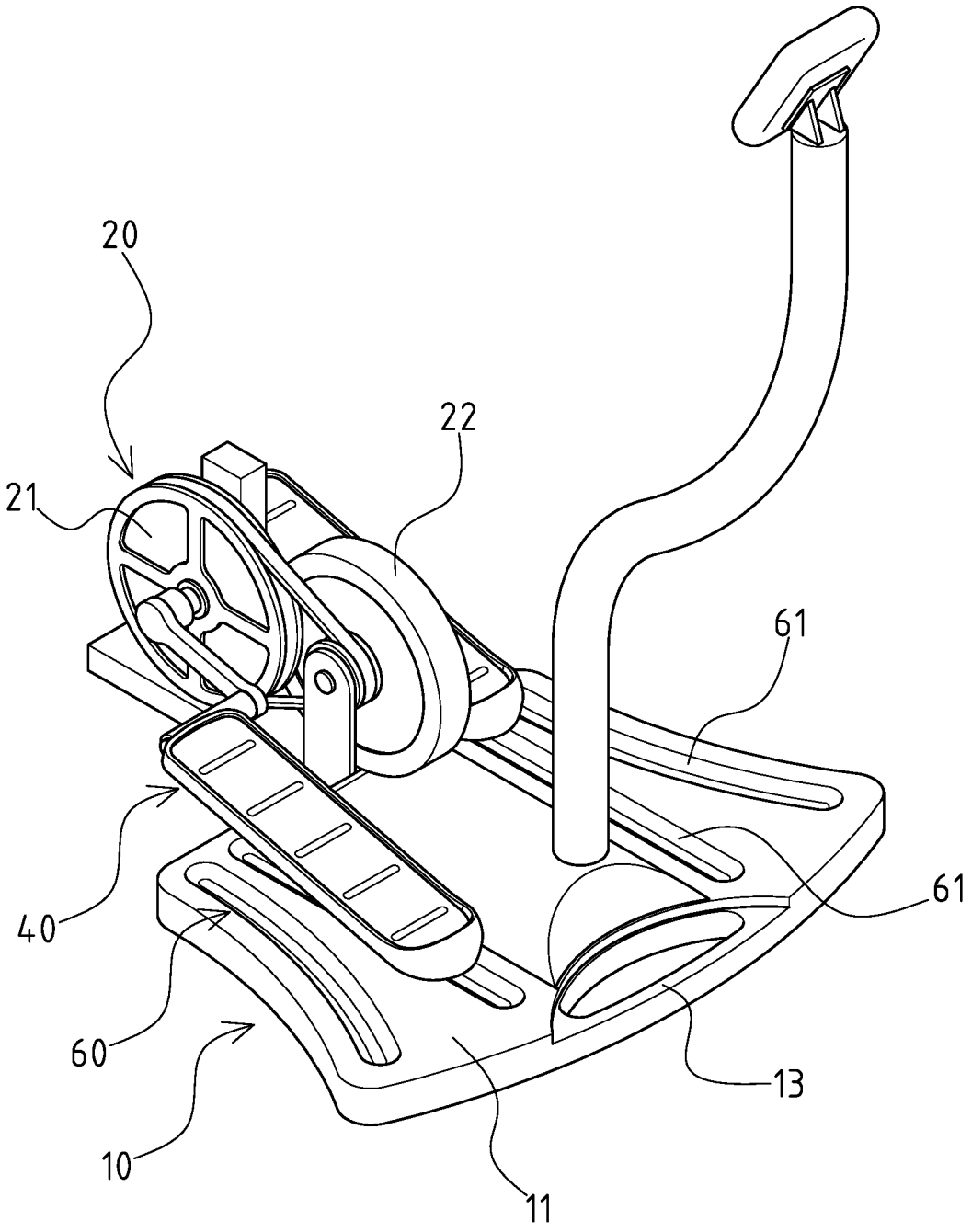
FIG. 1 is a perspective view of an elliptical stepper in accordance with the present invention.
Figure 2:
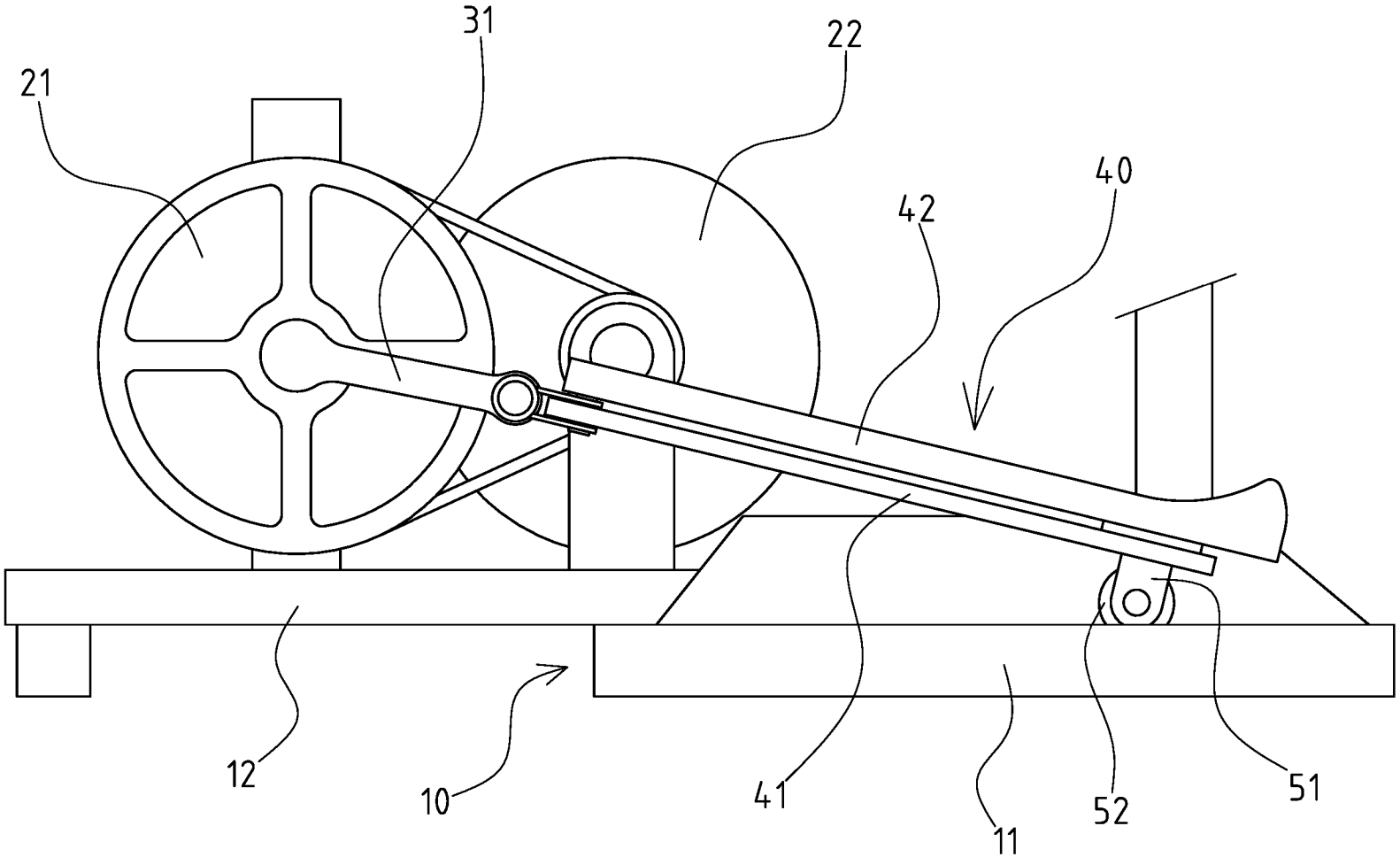
FIG. 2 is a partially side plan view of the elliptical stepper in FIG. 1.
Figure 3:
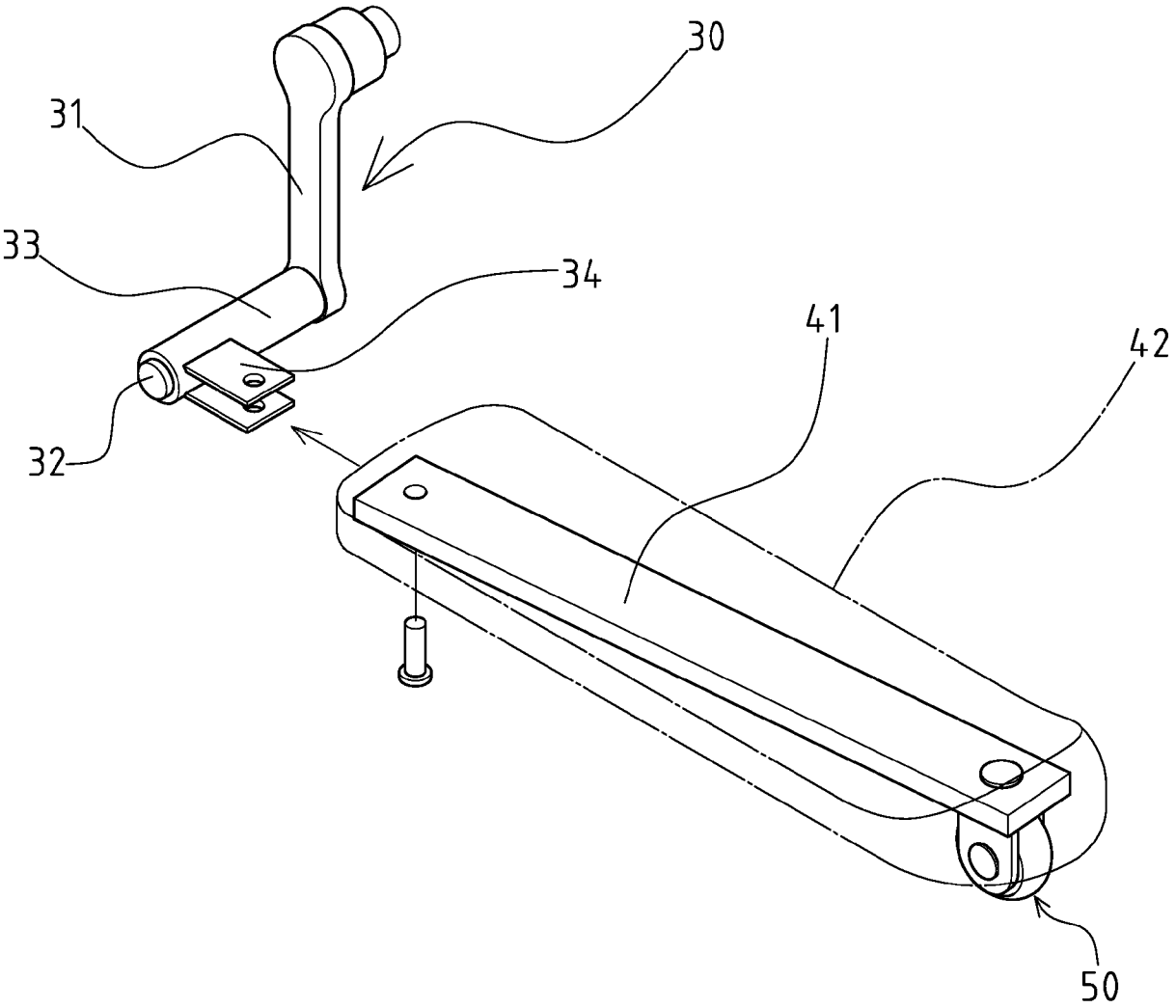
FIG. 3 is a partially exploded perspective view of the elliptical stepper in accordance with the present invention.
Figure 4:
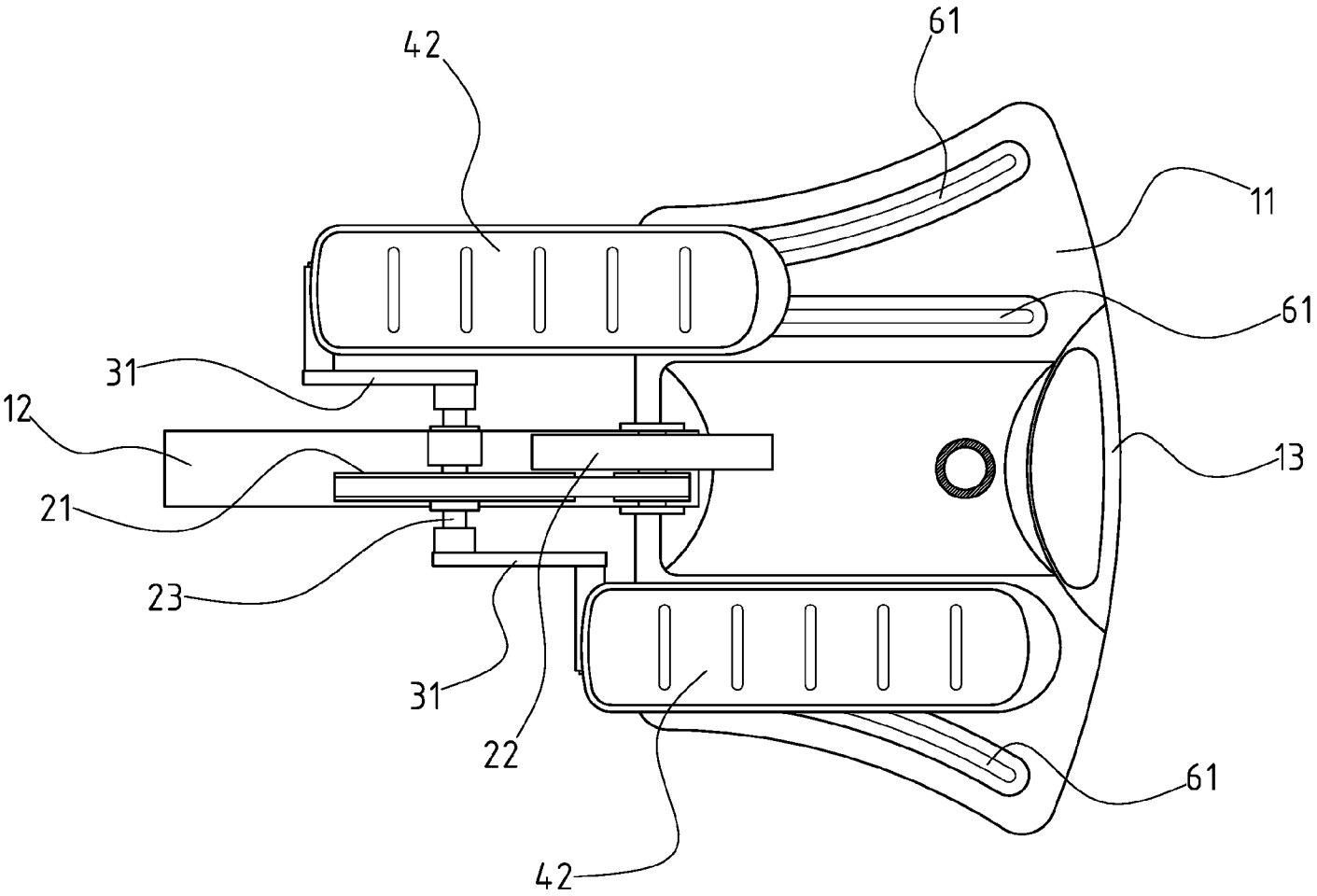
FIG. 4 is a top plan view of the elliptical stepper in accordance with the present invention.

Referring to the drawings and initially to FIGS. 1-4, an elliptical stepper in accordance with the present invention comprises a base 10, a damping device 20 mounted on the base 10, two crank devices 30 respectively laterally mounted to two opposite sides of the damping device 20. Each crank device 30 has a stepping device 40 mounted thereon and each stepping device 40 has a roller set 50 mounted to a bottom thereof, wherein the roller set 50 is universally rolled relative to a corresponding one of the two stepping device 40. The base 10 includes two opposite sides each having a guiding structure 60 disposed thereon. Each guiding structure 60 includes at least one rail 61 having a front end outwardly extending relative to a center line of the base 10. Each roller set 50 is moved along a corresponding one of the two guiding structures 60 such that each stepping device 40 provides a wiggling effect when moved along an elliptical route.

The base 10 is divided into a front section 11 and a rear section 12 detachably connected to each other. In the preferred embodiment of the present invention, each guiding structure 60 includes at least two rails 61, wherein at least one rail 61 has a front end outwardly extending relative to a center line of the base 10. A rail 61, adjacent to the center line of the base 10, is parallel to the center line of the base 10 and the other at least one rail 61 is curved. A handle 13 is disposed on the front section 11 of the base 10.

The damping device 20 is mounted onto the rear section 12 of the base 10. The damping device 20 includes a drive wheel 21 and a flying wheel 22 rotatably mounted onto the rear section 12 of the base 10, wherein the driver wheel 21 has an axle 23 centrally extending therethrough. The drive wheel 21 and the flying wheel 22 are simultaneously rotated with each other for providing resistance by using speed ratio and the weight of the flying wheel 22.

Each crank device 30 has an L-shaped crank 31 secured on a corresponding one of two opposite ends of the axle 23. The L-shaped crank 31 includes a horizontal section 32 having a sleeve 33 rotatably sleeved thereon. The sleeve 33 has two ears 34 extending therefrom.

Each stepping device 40 includes a bottom plate 41 pivotally connected to the two ears 34 of a corresponding one the two sleeves 33 and a pedal 42 mounted on the bottom plate 41.

Each roller set 50 includes a seat 51 pivotally mounted to a front end of a corresponding one of the two bottom plates 41 and a roller 52 rotatably mounted on the seat 51 such that the roller 52 is universally rotated relative to a corresponding one of the two stepping devices 40 and the moving route is limited by a corresponding one of the two guiding structures 60.

In the preferred embodiment of the present invention, the rail 61 is concaved and the roller 52 is partially received in the rail 61. However, the rail 61 also provides the guiding function when the rail 61 is convex and the roller 52 defines a groove (not shown) to partially received the rail 61.

Figure 5:
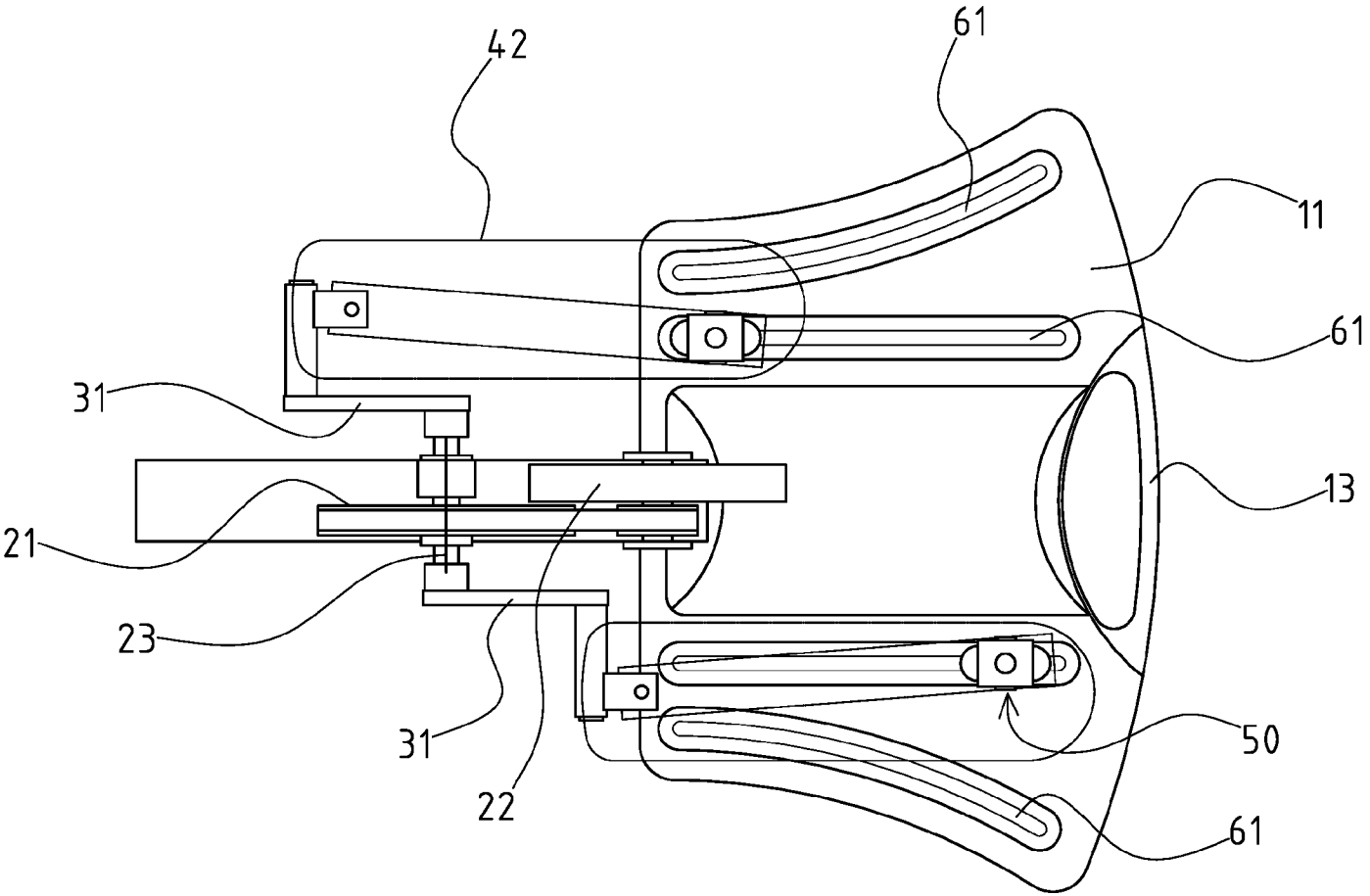
FIG. 5 is a first operational view of the elliptical stepper in accordance with the present invention.
Figure 6:
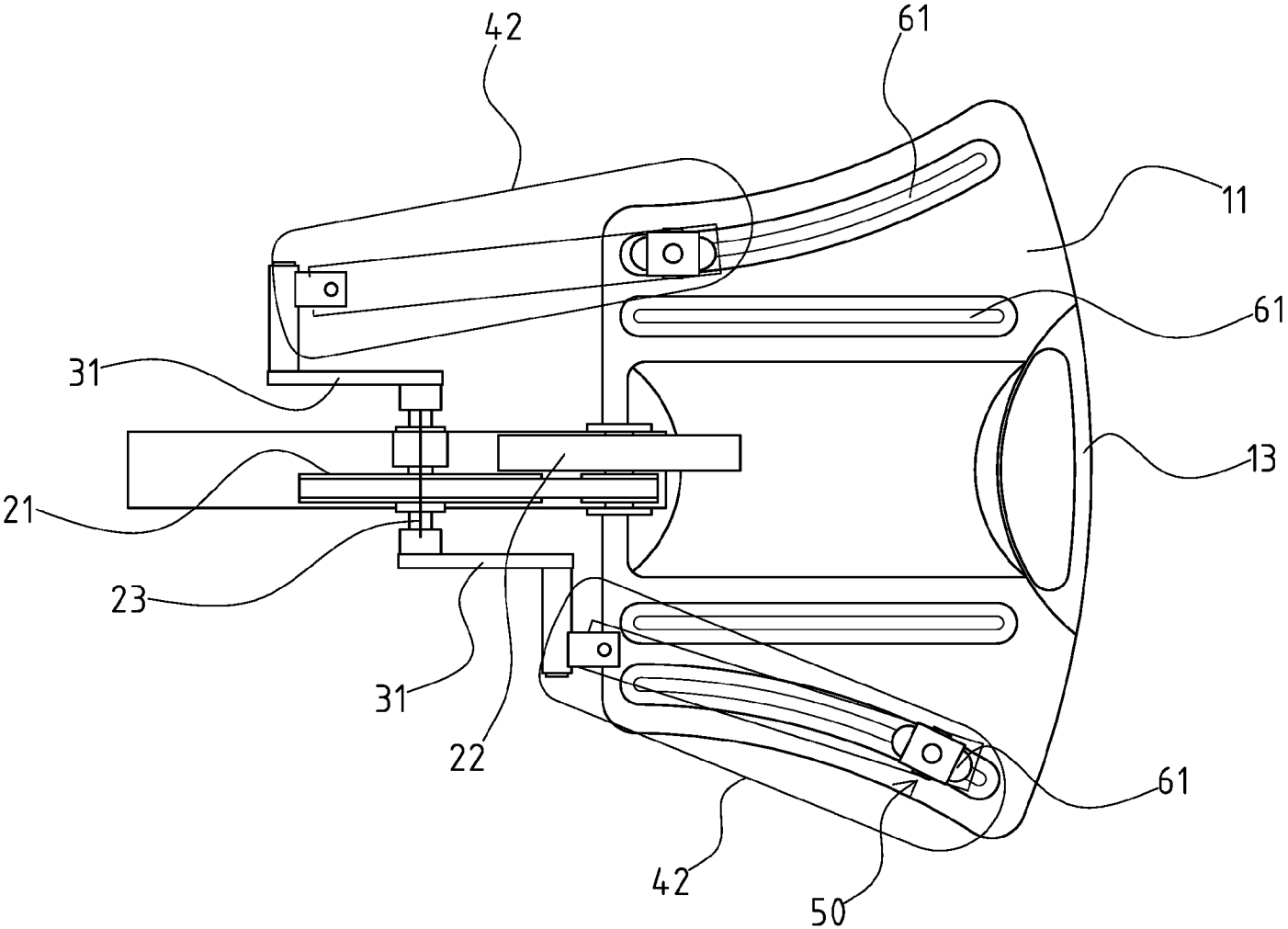
FIG. 6 is a second operational view of the elliptical stepper in accordance with the present invention.

With reference to FIG. 5, the stepping device 40 only moved along a vertical elliptical route when the roller 52 is partially received in the rail 61 adjacent the center line of the base 10. With reference to FIG. 6, the stepping device 40 further provides a wiggling effect when moved along an elliptical route and the roller 52 is partially in the rail 61 that has a front end outwardly extending relative to the center line of the base 10. The operator only needs to lift the front portion of the stepping device 40 and easily move the roller 52 from one rail 61 to another rail 61 when changing the moving mold of the stepping device 40. As a result, no tool is necessary.

Figure 7:
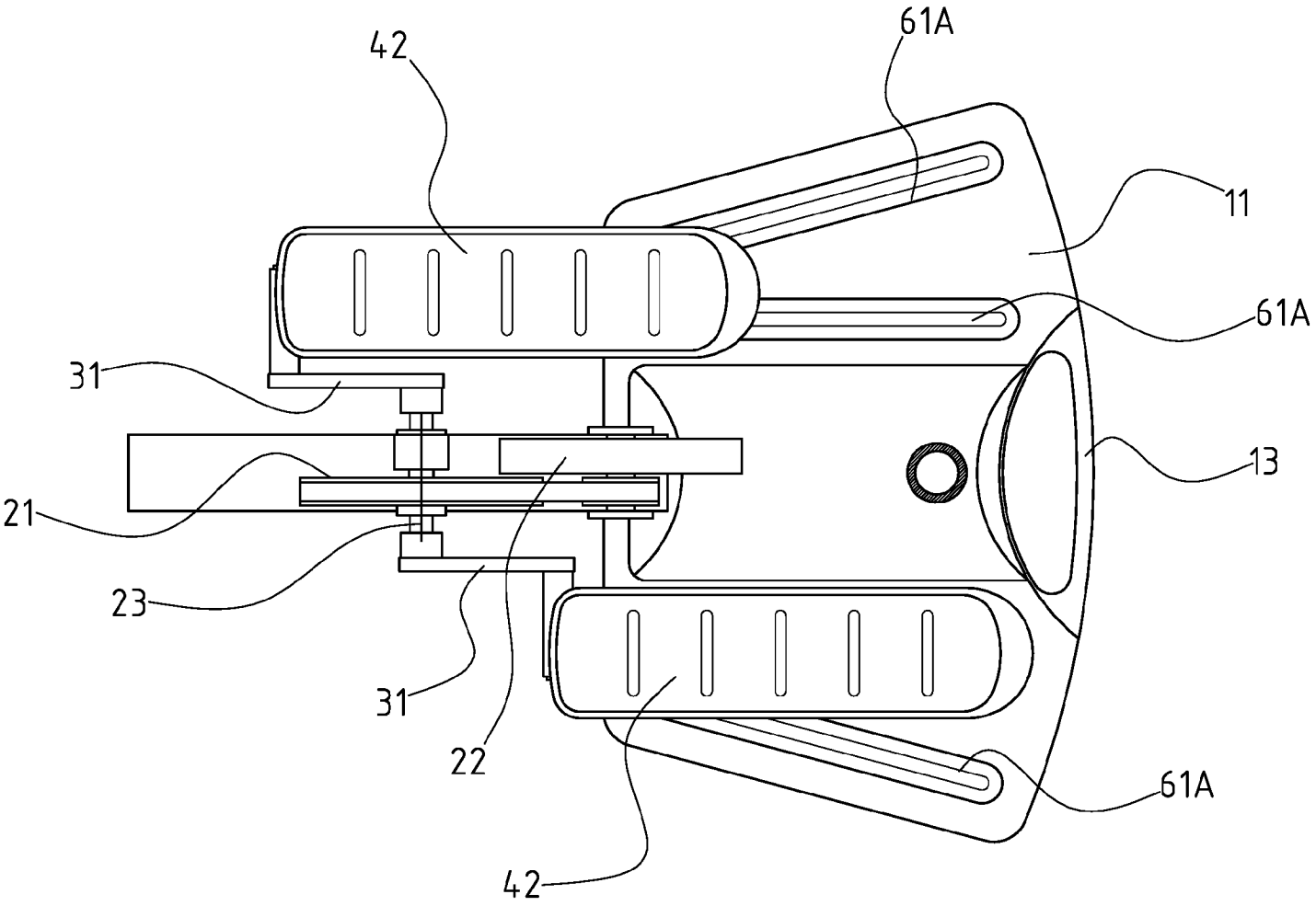
FIG. 7 is a top plan view of a second embodiment of the elliptical stepper in accordance with the present invention.

With reference to FIG. 7 that shows a second embodiment of the elliptical stepper in accordance with the present invention, in the preferred embodiment, all the rails 61A are linear.

Figure 8:
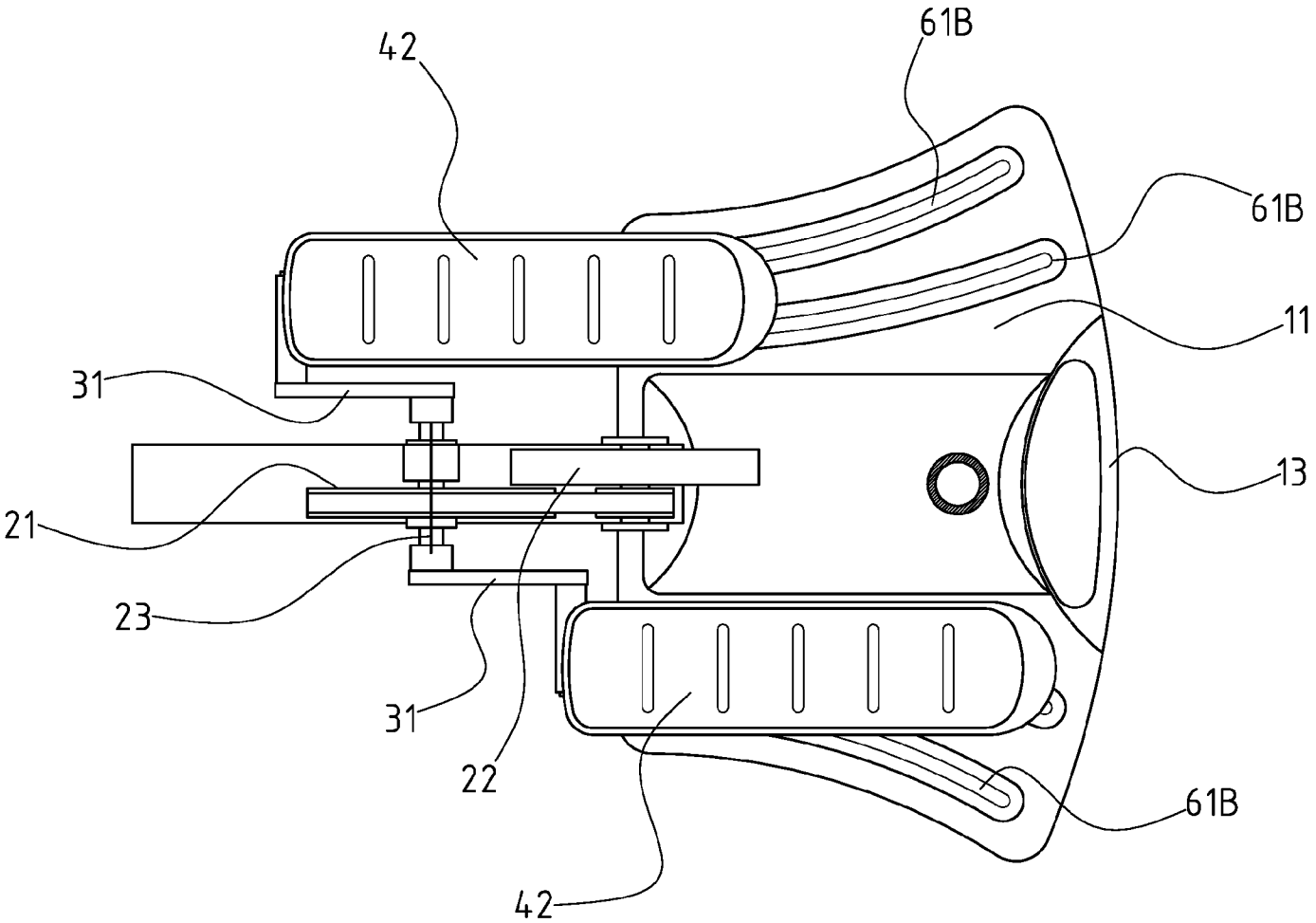
FIG. 8 is a top plan view of a third embodiment of the elliptical stepper in accordance with the present invention.

With reference to FIG. 8 that shows a third embodiment of the elliptical stepper in accordance with the present invention, in the preferred embodiment, all the rails 61B are curved. The curvature of each of the rails 61B of the guiding structure 60 is gradually raised relative to a distance between the center line of the base 10 and each rail 61B.

As described above, the front section 11 of the base 10 is detachably connected to the rear section 12 such that the operator changes the sport mold when changing the section 11 with different guiding structures 60.

Each roller set 50 is moved along a corresponding one of the two guiding structures 60 with at least one rail 61 having a front end outwardly extending relative to the center ling of the base 10 such that each stepping device 40 provides a wiggling effect when moved along an elliptical route. Consequently, the function and moving route of the elliptical stepper in accordance with the present invention is different from that of the conventional steppers. The guiding structure 60 has rails 61 with different guiding molds and the guiding mold is changed when lifting the front portion of the stepping device 40 and easily moving the roller 52 from one rail 61 to another rail 61. In addition, the front section 11 of the base 10 is detachably connected to the rear section 12 such that the operator changes the sport mold for providing various sporting routes when changing the section 11 with different guiding structures 60.

Although the invention has been explained in relation to its preferred embodiment, it is to be understood that many other possible modifications and variations can be made without departing from the spirit and scope of the invention as hereinafter claimed.

I claim:

1. An elliptical stepper apparatus comprising:

a base having a front section detachably connected to a rear section;

a first guiding structure disposed on one side of said base, said first guiding structure having a first rail that is curved and has a front end extending outwardly away from a center line of said base and a second rail that is linear and spaced inwardly from and separate from said first rail, said second rail being in parallel relation to the center line of said base;

a second guiding structure disposed on another side of said base, said second guiding structure having a first rail that is curved and has a front end extending outwardly away from the center line of said base and a second rail that is linear and spaced inwardly from and separate from said first rail of said second guiding structure, said second rail of said second guiding structure being in parallel relation to the center line of said base;

a damping device mounted on said base;

a first crank device laterally mounted on one side of said damping device, said first crank device having a first stepping device mounted thereon, said first stepping device having a roller set mounted to a bottom thereof, said roller set of said first stepping device receiving one of said first and second rails of said first guiding structure and being movable therealong; and a second crank device laterally mounted on an opposite side of said damping device, said second crank device having a second stepping device mounted thereon, said second stepping device having a roller set mounted to a bottom thereof, said roller set of said second stepping device receiving one of said first and second rails of said second guiding structure and being movable therealong.

2. The elliptical stepper apparatus of claim 1, said damping device being mounted onto said rear section of said base, said damping device having a drive wheel and a flying wheel rotatably mounted onto said rear section of the base, said drive wheel having an axle extending centrally therethrough.

3. The elliptical stepper apparatus of claim 2, each of said first and second crank devices having an L-shaped crank secured respectively to opposite ends of said axle, said L-shaped crank having a horizontal section with a sleeve rotatably mounted thereto, said sleeve having a pair of ears extending therefrom.

4. The elliptical stepper apparatus of claim 3, wherein each of said first and second stepping devices has a bottom plate pivotally connected to the pair of ears and a pedal mounted to said bottom plate.

5. The elliptical stepper apparatus of claim 4, wherein each of the roller set of said first and second crank devices has a seat pivotally mounted to a front end of said bottom plate and a roller rotatably mounted on said seat.

* * * * *